United States Patent [19]

Frenkler et al.

[11] Patent Number: 4,768,424

[45] Date of Patent: Sep. 6, 1988

[54] ROOF VENTILATOR

[75] Inventors: Friedrich K. Frenkler; Andreas Haug, both of Altensteig; Heinz Wieland, Waldenburg, all of Fed. Rep. of Germany

[73] Assignee: Wilhelm Gebhardt and Co. GmbH, Fed. Rep. of Germany

[21] Appl. No.: 35,275

[22] Filed: Apr. 3, 1987

Related U.S. Application Data

[63] Continuation of Ser. No. 777,632, Sep. 19, 1985, abandoned.

[30] Foreign Application Priority Data

Oct. 23, 1984 [DE] Fed. Rep. of Germany ..... 3438710

[51] Int. Cl.[4] ..... F24F 7/007; F24F 7/02

[52] U.S. Cl. ..... 98/42.02; 98/42.11; 98/DIG. 10

[58] Field of Search ..... 98/42.02, 42.11, 42.12, 98/42.13, DIG. 10; 415/206, 219 A, 219 C

[56] References Cited

U.S. PATENT DOCUMENTS 2,332,552 10/1943 Belanger ..... 98/42.13 X
2,711,682 6/1955 Drecalsel ..... 98/42.11
3,011,423 12/1961 Breidert ..... 98/42.02
3,946,648 3/1976 Schneider ..... 98/42.02

FOREIGN PATENT DOCUMENTS 2830606 1/1980 Fed. Rep. of Germany .... 98/DIG. 1D
1116535 5/1956 France ..... 415/206

*Primary Examiner*—Harold Joyce
*Attorney, Agent, or Firm*—Edgar A. Zarins; Steven L. Permut; Leon E. Redman

[57] ABSTRACT

A roof ventilator with a motor driven radial impeller (1) preferably having a vertical axis (15). It further comprises a housing for the impeller (1) which is connectable to the roof (20) or to a suitable wall of the room to be ventilated. On the side adjacent to the roof (20) or the wall, there is an inlet (5) extending in the direction of the impeller axis (15). The housing, which is designed as a flow housing, further comprises an outlet consisting of two outlet ports (16, 17) which are located on opposite first side walls (12, 13) of the housing. These side walls (12, 13) may be completely or almost completely open. This outlet design has the effect of diverting the medium flow away from the surroundings of the drive motor.

16 Claims, 7 Drawing Sheets

ROOF VENTILATOR

This is a continuation of co-pending application Ser. No. 777,632, filed on Sept. 19, 1985, now abandoned.

The invention relates to a roof ventilator with a motor driven radial impeller, preferably having a vertical axis, and a housing containing said radial impeller and connectable to the roof or to a suitable wall of the room to be ventilated and provided with an inlet in the direction of the impeller axis on the side adjacent to the roof or wall and with a radial outlet.

Roof ventilators are usually provided with a protective housing to protect the ventilator against the effects of the weather, or with a deflecting housing acting together with the outer circumference of the impeller to cause the air, after it has left the impeller in a rotationally symmetrical manner, to be discharged in the vertical or horizontal direction as required. Owing to its rotationally symmetrical flow from the impeller, a rotational movement is imparted to the discharging air, which acts against the further discharge of the air into the atmosphere and results in a relatively high noise level, which cannot be suppressed even by a silencer mounted downstream. The rotationally symmetrical discharge of the air, as has been indicated by the reference to its rotational momentum, further leads to a reduction or loss of performance, which is particularly detrimental if, as is increasingly required today, additional components such as silencers, ports etc. are fitted to the outlet side of the assembly.

To remove these drawbacks, additional measures are required, which complicate the design work and cause high manufacturing expenses. Nor are conventional roof ventilators suitable for applications in which the rooms to be ventilated contain hot gases or are liable to the development of hot gases, for instance in case of fire, since in this case the hot gases would flow past the motor, resulting in excessive overheating.

In order to remove the above drawbacks, the invention which is the subject of the present application aims at creating an assembly of the type referred to above, in which, on the one hand, directional flow can be achieved in order to decrease the rotational discharge component and thus the loss of performance, while, on the other hand, offering the motor better protection against the effects of hot gases, fumes etc. and improving its cooling arrangements, at the same time ensuring simple construction with simple, cost effective manufacture with regard to processes such as the cutting of blanks for the housing, where waste and scrap can be reduced. The invention further aims at a design which can be adapted to any conditions of application.

This problem is solved by a design, wherein the outlet of the housing designed as a flow housing consists of two outlet ports located on opposite first side walls of the housing, and wherein these side walls are completely or almost completely open, preferably so that the flow of the medium is directed away from the surroundings of the drive motor.

Since the air flows from the flow housing on two sides only in a directional and virtually irrotational manner, the performance of the ventilator is reduced to a lesser degree. The directional, irrotational discharge further contributes to a reduction of noise intensity, and the air is blown farther away. The motor can be cooled better if required, and the air drawn from the room to be ventilated is, in any case, directed away from the motor.

The construction of the ventilator according to the invention is very simple indeed, and since the manufacture of the housing is very simple, it can be produced in a cost effective manner. Nor do assembly and maintenance pose any problems, since the housing is accessible from two sides and the ventilator assembly can easily be removed from the site of application for repairs or the like by loosening the appropriate screws or other fastening elements.

A further advantage is offered by the possibility of fitting further components, such as additional air guidance elements, silencers etc. A so-called modular system is made available, enabling the provision of whole ventilator sets by mounting several such ventilators with their closed second side walls adjacent to and resting against each other. The ventilator according to the invention is therefore extremely versatile and adaptable. Finally, the new ventilator offers the opportunity of protectino the motor absolutely against hot or aggressive gases by the simplest of means. A roof ventilator which is in particular designed for the extraction of fumes can be provided with a standard, commercially available electrical foot or flange mounted motor mounted on the top wall of the housing. In this case, the motor is separated from the medium flow without requiring any further components and is in contact with the surrounding air only.

Advantageous further developments of the ventilator according to the invention are described in the subclaims.

BRIEF DESCRIPTION OF THE DRAWINGS

The drawing illustrates embodiments of the subject matter of the invention. Of these

DETAILED DESCRIPTION OF A PREFERRED EMBODIMENT OF THE PRESENT INVENTION

First, the basic internal construction of the roof ventilator will be described in detail with reference to FIGS. 1 to 3.

Figure 1:
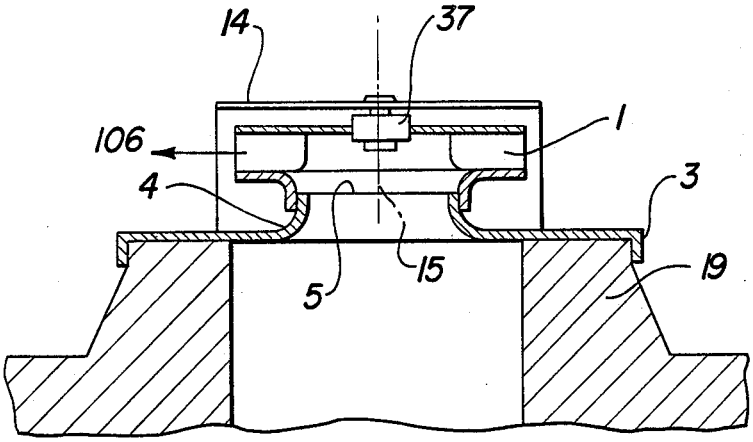
FIG. 1 shows the internal construction of a first embodiment of the subject matter of the invention in the form of a partial side view and a partial section.
Figure 2:
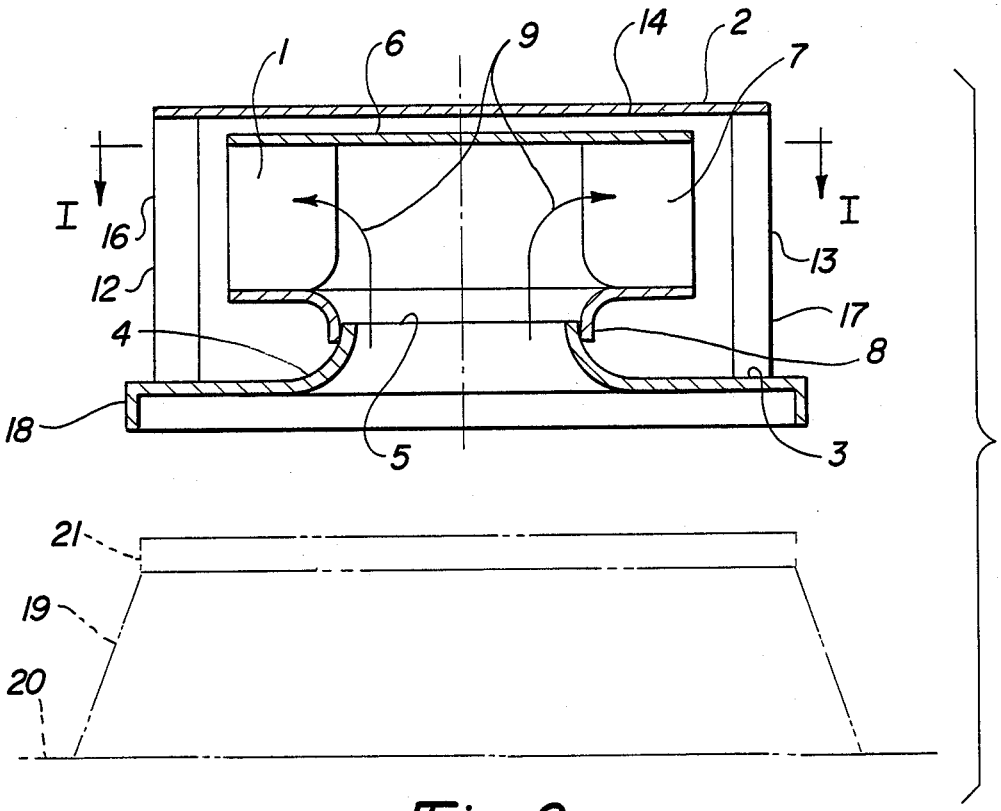
FIG. 2 is a detailed illustration of a ventilator of a similar type as represented in FIG. 1, without motor, in the form of a section along II—II of FIG. 3, the housing being represented in a diagrammatic form.

The roof ventilator is equipped with a radial impeller 1 driven by a motor 37 and preferably having a vertical axis 15, this radial impeller rotating in a flow housing 2 essentially consisting of sheet metal, which is diagrammatically represented in FIGS. 1 and 2. The housing is mounted on a base plate 3, through which the air drawn in by the impeller 1 flows into the interior of the housing and which is connected to the roof 20 or to a wall of the room to be ventilated by means of a plinth (19)(FIG. 1 illustrates the base plate mounted on the plinth, while FIG. 2 illustrates the base plate lifted off the plinth, which is indicated by a broken line and mounted on a roof). The base plate 3 contains an inlet 5, which is, in the embodiment in question, represented by a funnel-type inlet nozzle 4 and arranged coaxially with the impeller 1, so that the medium enters the impeller axially.

The impeller 1 is of the usual design, having a closed impeller wall 6 opposite the open inlet side, the impeller blades 7, which protrude towards the inlet 5 and are distributed evenly around the circumference, being attached to said impeller wall. On the inlet side of the impeller 1, there is further provided an equally funnel-shaped opening 8, which overlaps the inlet nozzle 4 to some degree.

The blades 7 are so arranged and designed that the air or the medium is discharged radially and sideways from the impeller 1 and the housing 2 as indicated by arrows 106. The flow corresponds to the arrows 9. The blades 7 are appropriately curved backwards, i.e the angle $\gamma$ enclosed by the blade and the circumference of the impeller and lying behind each blade if viewed in the direction of impeller rotation 28 is less than 90°. If the impeller blades are curved in this way, pressure conversion is largely effected in the impeller itself.

On the side opposite the base plate 3, the flow housing 2 is bordered by a top wall 14 lying parallel to the base plate 3 and forming the cover of the housing. This cover faces the impeller wall 6 (the impeller is driven from this side, the motor 37 being indicated in FIG. 1 only for clarity's sake).

Between the base plate 3 and the top wall 14, there are two second side walls 10, 11 extending at right angles to the base plate and top wall and being of a closed design. The flow housing 2 is further provided with two first side walls 12, 13, each of them located between two end sections of the second side walls 10, 11. These first side walls 12, 13 may extend parallel to each other and contain lateral outlets in the form of two outlet ports 16, 17, or they may be completely or almost completely open (as illustrated diagrammatically in FIGS. 4 to 7, the outlet ports may be covered additionally by grids, gratings 119, movable flaps or the like).

As a whole, the cross-section of the housing is essentially rectangular or square. The housing 2 is only indicated in FIG. 2. Further examples of various embodiments will be described below.

Figure 4:
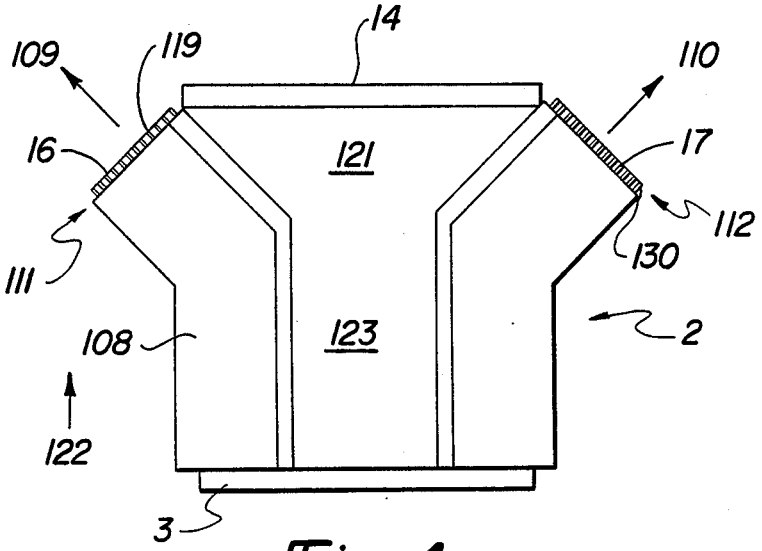

A first design of the flow housing 2 is illustrated in FIG. 4, the housing cross-section being of a rectangular or square shape at least in the proximity of the base plate 3, which is also rectangular or square. This shape simplifies assembly, involving less waste. At the same time, a quasi-modular structure is achieved, which can be adapted to a variety of conditions.

The outlet ports 16, 17 are so arranged on two opposite sides of the rectangle that the flow of the medium is directed away from the surroundings of the drive motor. The purpose of this arrangement is the protection of the motor against damage in cases in which the ventilator is used to extract hot air or gases. The base plate carrying the housing 2 is preferably made of sheet metal, its edges being folded downwards, i.e. towards the plinth, as indicated at 18 in FIG. 2, thus simplifying assembly to the plinth 19, which is appropriately equipped with a mounting border 21 corresponding to the folded part 18.

The invention provides for the radial impeller 1 to be integral with the associated drive motor, as indicated in FIG. 1, thus enabling the modular assembly of several roof ventilators of varying shapes and sizes, while the individual components of the assembly may be detachably connected to each other. This ensures maximum flexibility and adaptability to any practical requirements.

Figure 5:
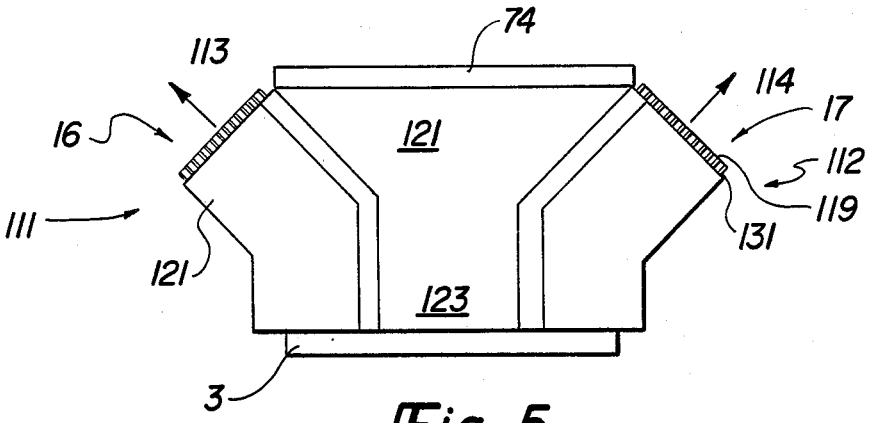
Figure 6:
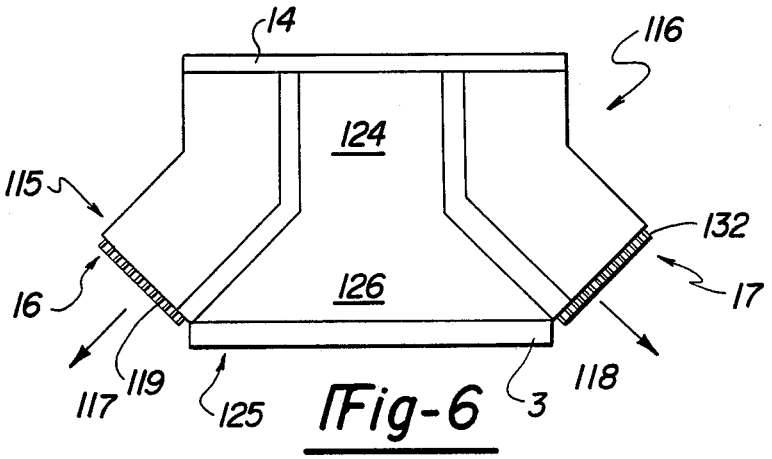

The housing outlet ports 16, 17 provided in the housing according to FIG. 4 and FIGS. 5 and 6 are located in areas forming convexities 111, 112 in opposite end faces or first side walls 12, 13 of the housing. In the embodiment according to FIG. 4, these convexities lying opposite each other or opposed to each other are located in that area of the ventilator which is remote from the plinth 19. The same applies to the embodiment according to FIG. 5. In the embodiment according to FIG. 6, on the other hand, the convexities 115, 116 lying opposite each other are located in that area of the ventilator which is adjacent to the plinth 19.

In the embodiments according to FIGS. 4 and 5, the discharge air is therefore directed upwards and sideways, i.e. diagonally upwards, so that the air flows upwards and outwards away from the plinth 19 or the roof 20 on the one hand and from the central axis on the other hand (as indicated by arrows 109, 110 in FIG. 4 and arrows 113, 114 in FIG. 5). In the embodiment according to FIG. 6, the discharging air is directed downwards and sideways, flowing as indicated by arrows 117, 118 diagonally downwards, i.e. towards the plinth or roof or base plate 3 and outwards and downwards away from the axis. These measures ensure excellent protection against hot air, hot or aggressive gases for the motor 37.

In the embodiments according to FIGS. 4 to 7, the side faces of the housing, which do not have any ports, are preferably contained in single planes from the lower to the upper end of the housing without having any convexities or concavities; This results in an essentially rectangular cross-section. This design is by no means the only possible solution, and further possible designs of the side faces will be described with reference to FIGS. 8 to 13.

If we examine FIGS. 4 to 7, we notice that the contour of the housing, if viewed from the side—from one of the side faces which do not contain any ports, i.e. one of the second side walls 10, 11, consists of two sections arranged consecutively in the axial direction, i.e. one section having a rectangular or approximately rectangular outline and another section having axially oriented opposite sides which are folded outwards in opposing directions in a roof-shaped manner. Between these two housing sections, there is a seamless, continuous transition offering not only manufacturing but also aesthetic advantages. In the arrangements according to FIGS. 4, 5 and 7, the section 121 having the outward-folded outline follows, if viewed in the outward direction from the plinth 19 according to arrow 122, i.e. from the bottom towards the top, after the section 123 having the rectangular or approximately rectangular outline. In the arrangement according to FIG. 6, on the other hand, the section 124 having the rectangular or approximately rectangular outline follows, if viewed in the outward direction from the plinth 19 according to arrow 125, preferably from the bottom towards the top, after the section 126 having the outward-folded outline.

The arrangement may be chosen in accordance with practical requirements, spatial conditions etc.

The difference between the embodiments according to FIGS. 4 and 5 lies in the fact that in the arrangement according to FIG. 4 the axial dimension of the section 123 having the rectangular outline is larger than, preferably twice as large as, the axial dimension of the section 121 having the outward-folded outline, whereas in the arrangement according to FIG. 5 the axial dimension of section 123 is approximately equal to that of section 121. These variations in length between the two sections are due to the fact that the impeller is driven by a built-in motor in the former case and by an externally mounted motor in the latter.

As can be seen, the lines of fold 130, 131, 132, 133 of the convexities extend in all embodiments parallel to the associated side faces and at right angles to the port-less side faces. It can be seen that, in the embodiments described so far, the outlet ports 16, 17 in the section with the outward-folded outline are either located in that face of the section which is directed outwards and upwards away from the axis, i.e. facing away from the plinth or the roof, as is the case in the embodiments according to FIGS. 4, 5 and 7, or else in that face of the section which is directed outwards and downwards, i.e. facing towards the plinth or the roof, as is the case in the embodiment according to FIG. 6.

By means of the outlet ports 16, 17, two virtually irrotational part-flows of the medium are achieved, ensuring the high performance of the ventilator according to the invention. This effect can be further enhanced by an advantageous design of the two second, port-less side walls 10, 11, as will be explained below.

The impeller 1 is advantageously centred in the flow housing 2, the two second side walls 10, 11 being arranged in 180° rotational symmetry relative to the impeller axis 15. Their arrangement therefore corresponds to a twofold symmetry, i.e. each second side wall 10, 11 may be imagined as created by rotating the other second housing wall about the impeller axis 15 by 180°.

Figure 3:
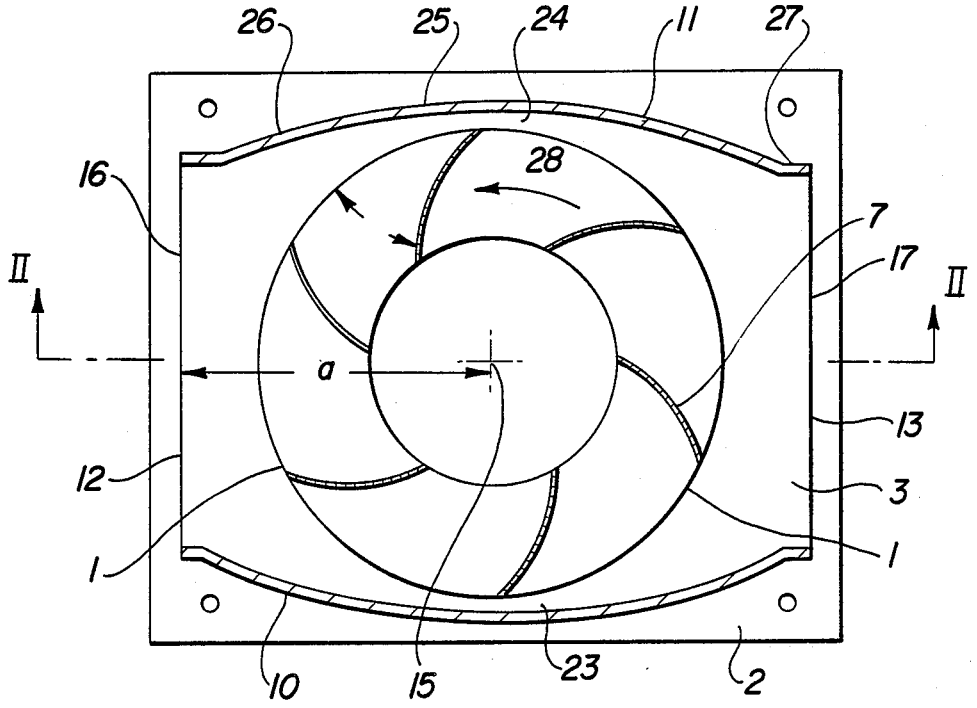
FIG. 3 is a top view of the roof ventilator according to FIG. 2, the top wall forming the cover of the housing having been cut off along I—I of FIG. 2, FIGS. 4–6 are diagrammatic side views of various embodiments of the subject matter of the invention.

The two second side walls 10, 11 of the flow housing 2 form, as is best illustrated in FIG. 3, narrow sections 23, 24 with the outer circumference of the impeller at approximately diametrically opposite points, resulting in stagnation points between the flow housing 2 and the outer circumference of the impeller. In this way, the air flow, which enters the impeller axially, is divided into two part-flows when leaving the impeller through the two stagnation points. Each of these part-flows leaves the ventilator directionally and virtually irrotationally by means of one of the open first side walls 12, 13 through the outlet port 16 or 17 with a high power density, the two part-flows being discharged far into the atmosphere in opposite directions.

In the interest of optimum flow, the minimum distance between each first side wall and the outer circumference of the impeller at the narrow points 23, 24 should be 2% to 15%, preferably 5% to 10%, of the external diameter of the impeller.

It also proved advantageous to have a point of minimum distance, if viewed in the direction of the impeller axis 15, in each of the narrow sections 23, 24, from where the distance between the outer circumference of the impeller and the associated second side wall 10, 11 increases in both directions.

The above applies to all the embodiments illustrated in FIGS. 3 and 8 to 13, can, however, also be incorporated in the remaining illustrated embodiments. The second side walls 10, 11 of the designs according to FIGS. 4 to 7 may, for instance, be flat on the outside while being shaped in accordance with the above explanations on the inside. The two second side walls may further in any case essentially consist of three wall sections each, these being a middle section 25 representing the narrow section and two outer sections 26, 27 on either side of the middle section and facing the first side walls 12, 13, these outer sections being appropriately essentially parallel to each other and straight, at least at their ends. Since the two second side walls 10, 11 are designed identically, only one of the side walls has been marked with the above reference numbers in the drawing.

There are, however, individual differences in the shape of the second side walls, i.e. in the way in which the narrow sections forming the stagnation points are achieved.

A suitable design is to have the narrow sections, if viewed in the direction of the impeller axis, widening from the point of minimum distance between the outer circumference of the impeller and the associated second side wall in a shape similar to a double wedge. Such an embodiment is shown in FIG. 3. The area representing the narrow section 23, 24—in this case the middle section 25 of the second side walls 10, 11—is shown to be curved. This wall section 25 is convex away from the impeller, being curved in the same direction as the associated section of the impeller circumference while having a larger radius of curvature. We therefore have here a relatively shallow convexity which may extend over an arc of approximately 90°. On either side of the section 25, there is an outer section 26 or 27 extending at a right angle to the first side walls 12, 13 and in one and the same plane, resulting in flush ventilator outlets on both sides. The assembly is further so arranged that the two second side walls 10, 11 have a mirror-image shape relative to a central plane extending through the impeller axis 15 (this central plane extends at a right angle to the plane II—II). The two second side walls 10, 11 also mirror each other relative to the longitudinal central plane of the ventilator, which corresponds to the plane II—II.

Figure 8:
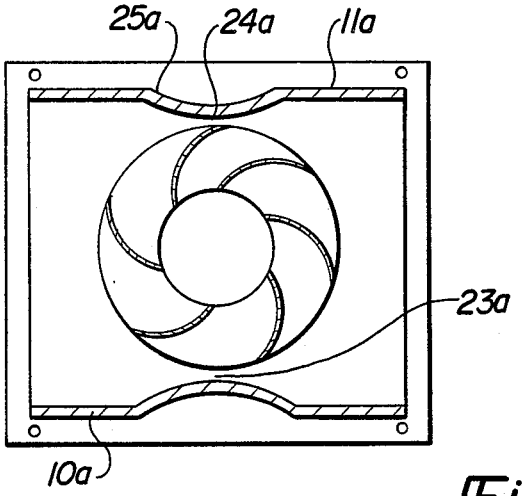

In FIG. 8, too, the area **25*a* of the second side walls 10, 11*a*, which represents the narrow section 23*a* or 24*a*, is rounded. In contrast to the embodiment according to FIG. 3, however, it forms a concavitiy directed towards the impeller, its curvature being opposed to the curvature of the adjacent part of the outer circumference of the impeller. Apart from this feature, this embodiment with concave middle section 25*a* corresponds to the ventilator according to FIG. 3**, further details thereof being contained in the description of that ventilator.

Figure 9:
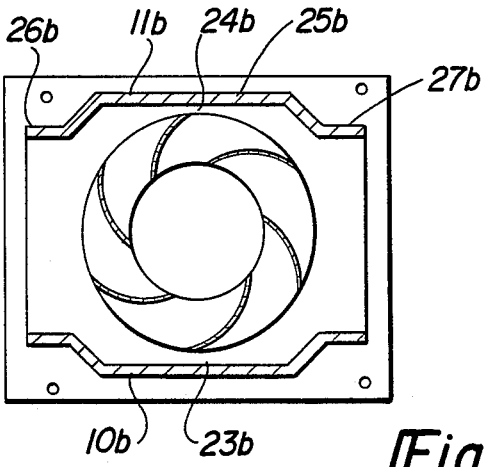
Figure 10:
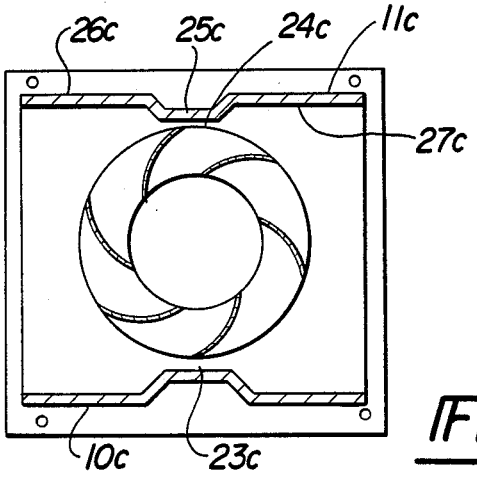

In the embodiments according to FIGS. 9 and 10, the narrow sections **23*b*, 24*b* and 23*c*, 24*c* respectively of which also have a double wedge shape, the design is so arranged that the section 25*b* or 25*c* of the second side walls 10*b*, 11*b* or 10*c*, 11*c* which represents the narrow section extends parallel to the tangent of the outer circumference of the impeller at the point of minimum distance between the outer circumference of the impeller and the associated second side wall. In the case of FIG. 9, this middle section 25*b* is contained as an elevation in the associated first side wall, whereas in FIG. 10 the middle section 25*c* forms a recess in the associated side wall. In accordance with FIGS. 9 and 10, the middle section 25*b* or 25*c* extending parallel to the tangent of the outer circumference of the impeller can be offset in a step-like manner relative to the adjacent outer wall sections 26b, 27b; 26c, 27c. Apart from that, conditions are identical to those already described. In each case, there are first side walls arranged with twofold symmetry relative to each other, and the flow housing is furthermore symmetrical with respect to the longitudinal and the transverse central planes. In the embodiments according to FIGS. 9 and 10, the three wall sections 25b, 26b, 27b or 25c, 26c, 27c** respectively are parallel to each other, the steps between the middle section and the associated outer sections being either rectangular or, as illustrated, forming an angle of approximately 45° with the plane of the side walls. Owing to the tangential arrangement of the middle section of the side walls and the curvature of the external circumference of the impeller, the shape of the narrow sections is similar to a double wedge.

Figure 11:
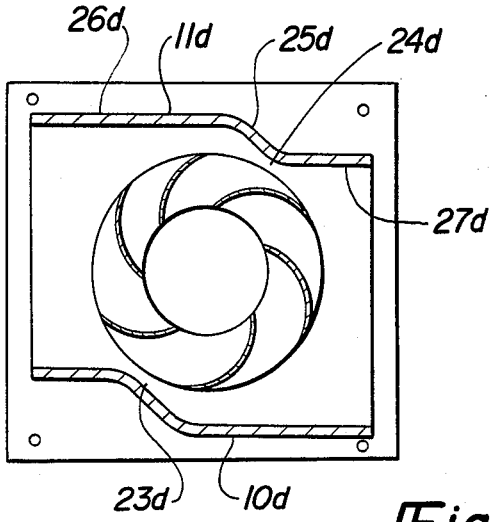

The two second side walls 10d and 11d illustrated in FIG. 11 have a section 25d representing the narrow section 23d or 24d respectively, which has a wave-like shape with a point of contraflexure. In the embodiment illustrated the curvature of this section, which corresponds to that of the outer circumference of the impeller, has a larger radius than the outer circumference of the impeller. The point of minimum distance between the outer circumference of the impeller and the associated second side wall is bounded by that part of the section 25d which is curved away from the impeller. The narrow section 25d is close to the point of contraflexure. The two outer sections 26d, 27d are parallel in the embodiment illustrated and thus extend at rights angles to the first side walls, being, however, offset relative to each other. There is a continuous transition between the S- or wave-shaped middle section 25d and the outer sections 26d, 27d. This S- or wave-shaped arrangement once again results in a narrow section having a double wedge shape. In this case, the two narrow sections 23d, 24d are not situated in the transverse central plane of the ventilator but in an inclined plane.

Figure 12:
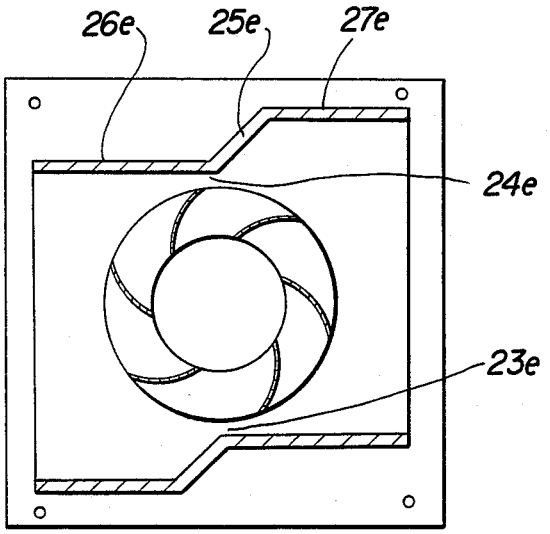
Figure 13:
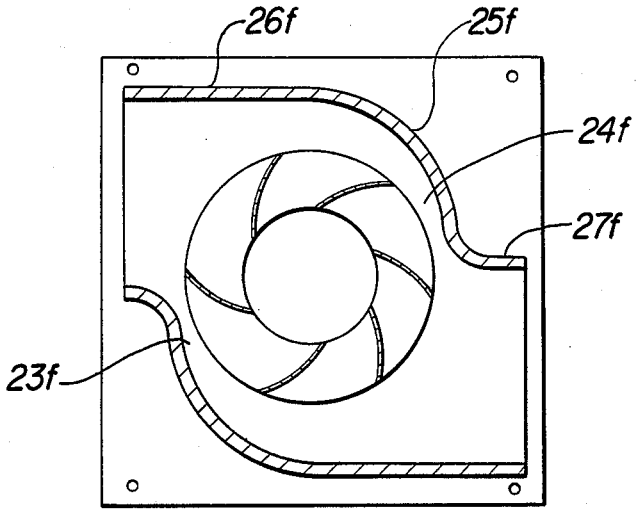

The distance between the circumference of the impeller and the first side wall may also increase discontinuously. FIGS. 12 and 13 show two suitable embodiments of this arrangement with discontinuous enlargement on one side of the narrow section only. In the case of FIG. 12, the wall section 26e extends in a straight line towards the impeller circumference until the point of minimum distance is reached, from where, forming an angle which may be radiussed, a straight section 25e leads away from the impeller, the other end of which changes into the other outer section 27e. The narrow section is represented by the kink between the sections 24e and 26e. The outer section 26e is parallel to the tangent of the impeller at the point of minimum distance. The two narrow sections 23e and 24 lie diametrically opposite each other in the transverse central plane of the ventilator. The other outer section 27e also extends in a straight line and parallel to but offset against the section 26e.

In the case of FIG. 13, too, one of the outer sections, i.e. 27f, extends towards the point of minimum distance between the outer circumference of the impeller and the side wall, i.e. as far as the narrow section 23f or 24f from where, also forming an angle which may be radiussed, a middle section 25f leads away from the impeller, this being rounded in this case. The curvature, which is in the same direction as that of the impeller circumference, is so designed that the distance between the impeller circumference and the wall section 25f gradually increases from the point of minimum distance. At the end opposite to section 27f, section 25f changes over onto the other outer section 26f. Section 27f, which is directed towards the impeller circumference, is neither tangential nor, as in the case of FIG. 12, parallel to the tangent, but rather so arranged that its imaginary extension intersects the transverse central plane of the ventilator between the impeller axis and the outer circumference of the impeller, the point of intersection in the embodiment illustrated being approximately in the middle between the outer circumference and the axis of the impeller.

As in the case of FIG. 11, the two first side walls of the ventilators according to FIGS. 12 and 13 are offset parallel to each other.

In all the illustrated embodiments the directional and irrotational discharge of the medium can be further enhanced by having the length of the second side walls 10, 11 equal to or greater than the length of the first side walls 12, 13, each first side wall 12, 13 having a distance of 51% to 75% of the impeller diameter from the impeller axis 15.

Figure 14:
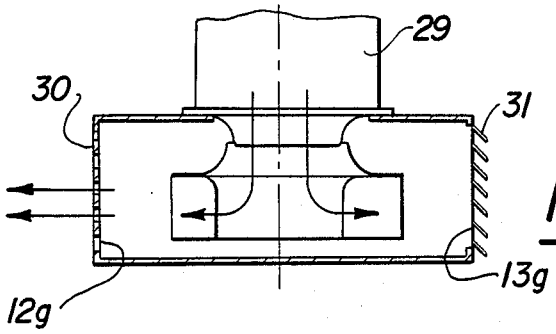

The ventilator described in various versions may also be used as a draught ventilator or wall ventilator. The former application is illustrated in FIG. 14. Only the fold 18 at the base has been omitted; apart from that, the flow housing may be as described above. The ventilator is merely inverted, the base plate being flange mounted on a duct 29, through which the outside air is axially drawn in and discharged radially into the building by means of a ventilator.

The ventilators described offer a further advantage in that several ventilators can be arranged side by side, their second side walls facing each other, enabling complete ventilator sets to be assembled.

Elements such as silencers, flaps, grids etc. may be fitted downstream, resulting in a versatile modular system. For this purpose, the first side walls 12, 13 should be provided with connection facilities such as flanges for these additional components. In the embodiments illustrated with their completely open side walls 12, 13, the only measure required would be the folding of the edges of the closed second side walls 10, 11 and of the top wall 14 to form the necessary flanges.

Attachments of this kind are described below with reference to FIGS. 7 and 14 to 16.

Figure 7:
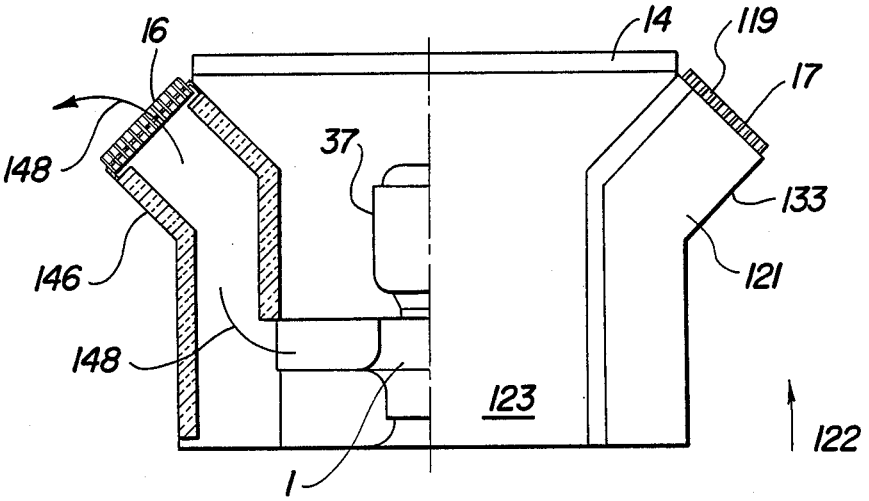
FIG. 7 is a further diagrammatic side view and partial section of a further embodiment of the subject matter of the invention, FIGS. 8–13 each show a further embodiment of the roof ventilator according to the invention as represented in FIG. 3, and FIGS. 14–19 are diagrammatic side views and partial sections of further embodiments of the roof ventilator according to the invention.

In the embodiment according to FIG. 7, the end face of the housing which carries the outlet ports 16, 17 has been provided with a silencer arrangement 146, so that the air leaving the impeller 1 is guided in accordance with arrows 148. 37 is the drive motor.

In the embodiment according to FIG. 14, a grid 30 indicated in diagrammatic form has been fitted to the housing wall 12g, so that the air is discharged through the grid in a linear manner. The opposite first side wall 13g, on the other hand, has been fitted with a deflecting device 31 to direct the discharging air downwards into the room. It is, of course, understood that the two open side walls will be equipped with the same attachment in practical application.

Figure 15:
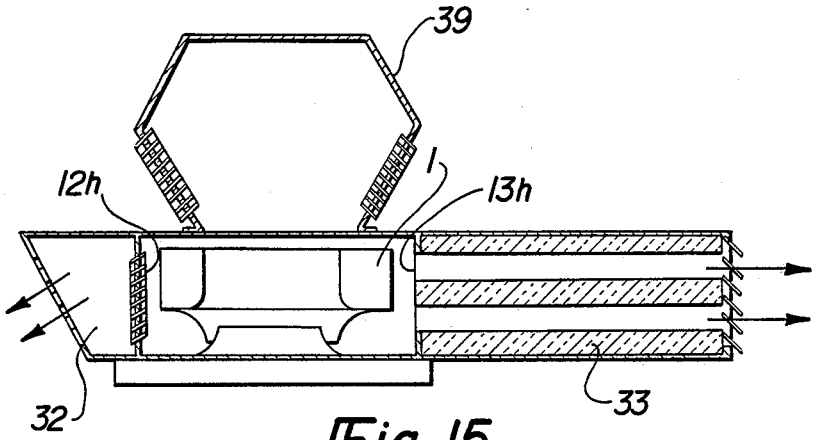

In accordance with FIG. 15, air guidance elements for the horizontal discharge of the air may be fitted to the first side walls 12h, 13h; these may consist of a hood-shaped discharge piece 32 or of a horizontal silencer tube 33. It is further possible to mount flaps downstream of the outlet ports to protect the ventilator, whether it is in operation or not, against rain water or cold air.

Figure 16:
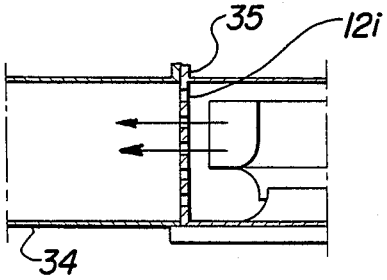

In the embodiment according to FIG. 16, an air duct 34 is fitted to the open first side wall 12*i* (a suitable flange connection is indicated at 35). Through this, the discharging air may be ducted into another downstream assembly such as a heat recovery unit.

Figure 17:
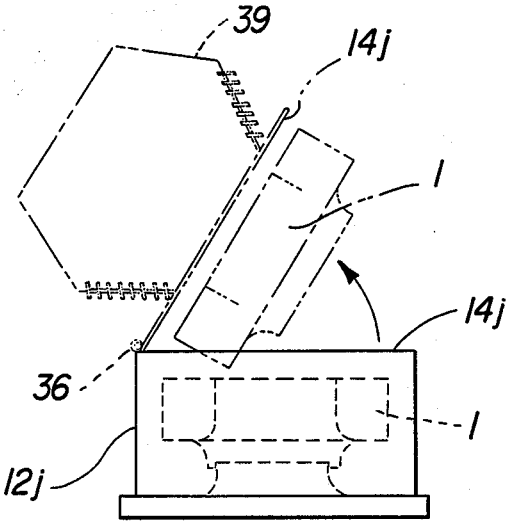

Owing to the two open side walls, the internal ventilator components are easily accessible, which greatly facilitates maintenance. This is made even easier by the hinged top cover 14*j* of the housing illustrated in FIG. 17. For this purpose, a conventional hinge 36 may, for instance, be fitted to the upper edge of one of the housing side walls. In the case illustrated in FIG. 17, the hinge 36 is attached to the upper edge of the open first housing wall 12*j*, which is adjacent to the front edge of the top wall 14*j*. When this is opened from the operating position and moved into maintenance position as indicated by the broken line, the impeller 1 attached to the top wall is removed from the housing together with the drive motor here not illustrated. In this way, the impeller 1 is made completely accessible.

Figure 18:
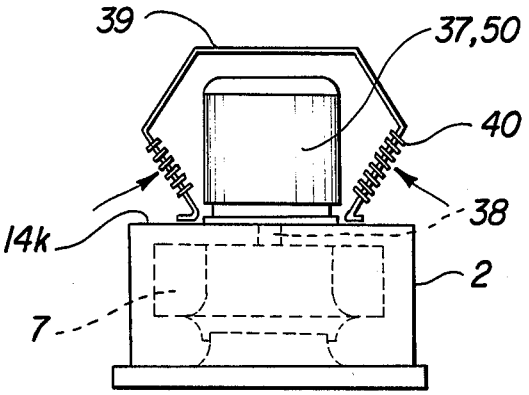

Of the illustrations described so far, only FIGS. 1 and 7 show the drive motor 37 for the impeller. FIG. 18 shows a further suitable drive arrangement. The motor 37 is a commercially available standard electrical foot or flange mounted motor externally mounted 50 on the top wall 14*k* of the flow housing 2. The impeller 1 is driven in the housing 2 through the top wall 14*k*, and the impeller 1 may be directly mounted on the motor shaft 38. Drive by means of a V-belt is, however, also possible. The arrangement according to FIG. 18 is particularly suitable for fume ventilators, since the motor is situated outside the flow of the medium and cooled by atmospheric air. The provision of a protective housing 39 with cooling slots 40 for the motor is yet another appropriate solution (cf. FIGS. 15, 17 and 19). A ventilator of this type can be used for aggressive media, for instance in the chemical industry.

In an embodiment not illustrated here, which would best have a V-belt drive, the electrical motor could be a built-in motor mounted on the top wall and extending into the housing; a suitable motor for this purpose would be an internal rotor motor.

Figure 19:
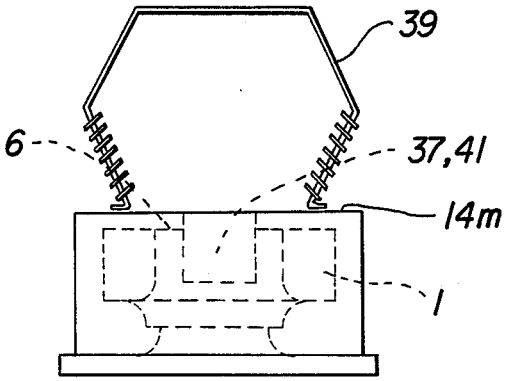

The drive motor 37 may finally, as shown in FIG. 19, be a built-in motor 41 extending into the housing from the top wall 14*m*, but in this case designed as an external rotor motor. In the embodiment shown, this extends into the impeller 1, into the space enclosed by the blades. The impeller 1 is appropriately connected directly to the rotating external rotor of the motor, for instance by having the impeller wall 6 flanged to the external rotor.

Finally, it should once more be pointed out that by the straight design of the two second side walls 10, 11 alone considerable improvements in power density can be achieved. The essentially rectangular external outline of the housing can, however, be maintained even if the side walls are shaped in order to create a stagnation point, since the external shape remains straight while the internal walls are shaped accordingly. There is further no need of providing the ventilator according to the invention with a virtually rectangular cross-section; the second side walls 10, 11 may well have one of the shapes illustrated in FIGS. 3 and 8 to 11.

We claim:

1. A roof ventilator adapted to be mounted to the roof or wall of a housing structure to be ventilated, said ventilator comprising:

a substantially rectangular housing with peripheral side walls, said housing having a pair of oppositely disposed outlet ports formed in opposing side walls of said housing interdisposed between a pair of opposing solid side walls, said solid side walls configured to direct medium flow laterally towards said outlet ports of said housing;

a radial impeller with a vertical rotational axis, said impeller disposed within said housing between said peripheral side walls, said impeller having an inlet port axially aligned with said rotational axis of said impeller and a radial outlet to direct medium flow towards said peripheral side walls of said housing;

a drive motor for rotatively driving said impeller, said drive motor integrally connected with said impeller and adapted to be mounted to said housing; and means for mounting said ventilator to said structure;

wherein medium flow is directed from said axial impeller inlet and radially outward away from said drive motor through said outlet ports of said housing, said solid side walls configured to direct medium flow laterally away from said drive motor and towards said outlet ports whereby said drive motor is not affected by the medium flow within said housing.

2. The ventilator as defined in claim 1 wherein said mounting means comprises a base plate of said housing detachably connected to a plinth secured to said structure.

3. The ventilator as defined in claim 2 wherein said base plate is formed of sheet metal having a peripheral rim folded perpendicular to said base plate towards said plinth and wherein said inlet port of said radial impeller is detachably connected to an opening in said base plate whereby said impeller and drive motor may be interchanged with ventilators of various types and sizes.

4. The ventilator as defined in claim 1 wherein said drive motor is mounted within said housing isolated from the medium flow to said outlet ports by a dividing wall.

5. The ventilator as defined in claim 1 wherein said drive motor is mounted externally of said housing yet drivably connected to said impeller.

6. The ventilator as defined in claim 1 and further comprising a pair of flow chambers disposed outwardly from and in communication with said outlet ports of said housing, said flow chambers having an upper end and a lower end and defining a flow path parallel to the axis of said impeller to divert the ventilated gases away from said drive motor.

7. The ventilator as defined in claim 6 wherein said flow chambers include outlet ports disposed at the upper end of said chamber which direct said flow medium upwardly and outwardly from said housing.

8. The ventilator as defined in claim 6 wherein said flow chambers include outlet ports disposed at the lower end of said chamber which direct said flow medium downwardly and outwardly from said housing.

9. The ventilator as defined in claim 1 wherein detachably mounted to said outlet port of said housing are deflector means.

10. The ventilator as defined in claim 1 wherein detachably mounted to said outlet ports of said housing are silencing means.

11. The ventilator as defined in claim 1 wherein said opposing solid side walls include wall portions to direct medium flow towards said outlet ports.

12. The ventilator as defined in claim 11 wherein said opposing solid side walls have a partial arcuate cross-section which closely conforms to the configuration of the outer periphery of said impeller to thereby direct medium flow laterally towards said outlet ports.

13. The ventilator as defined in claim 11 wherein said wall portion of said solid side walls extend inwardly toward said impeller to direct medium flow towards said outlet ports.

14. A roof ventilator adapted to be mounted to the roof or wall of a housing structure to be ventilated, said ventilator comprising:

a substantially rectangular housing with peripheral side walls, said housing having a pair of oppositely disposed outlet ports formed in opposing side walls of said housing interdisposed between a pair of opposing solid side walls having means for deflecting the flow medium laterally towards said outlet ports;

a radial impeller with a vertical rotational axis, said impeller disposed within said housing between said peripheral side walls, said impeller having an inlet port axially aligned with said rotational axis of said impeller and a radial outlet to direct medium flow from said impeller towards said peripheral side walls of said housing;

a drive motor for rotatively driving said impeller, said drive motor drivably connected with said impeller and adapted to be mounted to said housing; and means for mounting said ventilator to said structure;

wherein medium flow is directed from said axial impeller inlet and radially outwardly away from said drive motor through said outlet ports of said housing whereby said solid side walls direct medium flow laterally outwardly away from said drive motor and towards said oppositely disposed outlet ports such that said drive motor is not affected by the medium flow within said housing.

15. The ventilator as defined in claim 14 wherein said mounting means comprises a base plate of said housing detachably connected to a plinth secured to said structure.

16. The ventilator as defined in claim 14 wherein said means for deflecting the flow medium towards said outlet ports comprises wall portions of said solid side wall configured to deflect the radially outward medium flow towards said outlet ports.

* * * * *